US010378215B2

(12) United States Patent
Drochon et al.

(10) Patent No.: US 10,378,215 B2
(45) Date of Patent: Aug. 13, 2019

(54) ATTACHMENT SYSTEM, E.G., FOR PANELS

(71) Applicant: APLIX, Le Cellier (FR)

(72) Inventors: Véronique Drochon, Le Cellier (FR); Nathalie Moinard, Le Cellier (FR)

(73) Assignee: Aplix, Le Cellier (FR)

( * ) Notice: Subject to any disclaimer, the term of this patent is extended or adjusted under 35 U.S.C. 154(b) by 0 days.

(21) Appl. No.: 15/762,605

(22) PCT Filed: Sep. 23, 2016

(86) PCT No.: PCT/FR2016/052415
§ 371 (c)(1),
(2) Date: Mar. 23, 2018

(87) PCT Pub. No.: WO2017/051132
PCT Pub. Date: Mar. 30, 2017

(65) Prior Publication Data

US 2018/0298617 A1 Oct. 18, 2018

(30) Foreign Application Priority Data

Sep. 24, 2015 (FR) ..... 15 59016

(51) Int. Cl.
*A44B 18/00* (2006.01)
*E04F 13/08* (2006.01)
*E04F 15/02* (2006.01)

(52) U.S. Cl.
CPC ..... *E04F 13/0882* (2013.01); *A44B 18/0015* (2013.01); *A44B 18/0057* (2013.01); (Continued)

(58) Field of Classification Search
CPC ..... E04F 13/0882; E04F 15/02138; A44B 18/0015; A44B 18/0069; A44B 18/0057; A44B 18/0003; A44D 2205/00
See application file for complete search history.

(56) References Cited

U.S. PATENT DOCUMENTS 3,009,235 A 11/1961 De Mestral
3,991,534 A * 11/1976 Brumlik ..... E04B 1/49 52/489.2

(Continued)

FOREIGN PATENT DOCUMENTS

EP 0777006 A1 6/1997
FR 2868135 A1 9/2005

(Continued)

OTHER PUBLICATIONS

International Search Report and Written Opinion with English translation dated Jun. 14, 2017, in corresponding International Application No. PCT/FR2016/052415 (13 pages).

(Continued)

*Primary Examiner* — Rodney Mintz
(74) *Attorney, Agent, or Firm* — Bookoff McAndrews, PLLC

(57) ABSTRACT

A system for fastening a covering on a surface includes a first assembly comprising a first retaining element; and a second assembly comprising a second retaining element; the first and second retaining elements being configured to engage each other so as to form a reversible bond; the system being characterized in that the first retaining element comprises an array of retaining elements comprising hooks having a height (Hc) lying in the range 0.05 mm (0.0020 in) to 1 mm (0.039 in), and the second retaining element comprises an array of retaining elements comprising loops having a height (Hb) lying in the range 0.1 mm (0.0039 in) to 3.0 mm (0.12 in).

20 Claims, 1 Drawing Sheet

(52) U.S. Cl.
CPC .... *A44B 18/0069* (2013.01); *E04F 15/02138* (2013.01); *A44B 18/0003* (2013.01); *A44D 2205/00* (2013.01)

(56) References Cited

U.S. PATENT DOCUMENTS 4,744,189 A * 5/1988 Wilson ..... B44C 1/28 40/908
4,863,127 A * 9/1989 Handler ..... A47B 57/06 248/205.2
4,974,384 A * 12/1990 Pacione ..... E04B 1/168 52/241
5,060,443 A * 10/1991 Pacione ..... E04F 13/0882 428/100
5,133,166 A * 7/1992 Pacione ..... E04B 1/168 52/250
5,144,786 A * 9/1992 Pacione ..... E04F 13/0882 52/511
5,259,163 A * 11/1993 Pacione ..... E04F 15/02138 52/269
5,412,918 A * 5/1995 Wendel ..... E04B 1/6108 403/13
5,482,755 A * 1/1996 Manning ..... A44B 18/00 428/100
5,685,050 A * 11/1997 Murasaki ..... A44B 18/0061 24/442
6,298,624 B1 * 10/2001 Pacione ..... A47G 27/025 52/311.2
6,306,477 B1 * 10/2001 Pacione ..... A47G 27/0293 428/62
6,367,218 B2 * 4/2002 Lombardo ..... B44C 1/28 52/311.2
6,460,303 B1 * 10/2002 Pacione ..... A47G 27/025 428/100
6,797,353 B1 * 9/2004 Pacione ..... A47G 27/0293 428/62
7,185,465 B2 * 3/2007 Pacione ..... A47G 27/0293 52/311.2
7,185,473 B2 * 3/2007 Pacione ..... A47G 27/025 428/62
7,194,843 B2 * 3/2007 Pacione ..... A47G 27/025 52/552
9,624,661 B2 * 4/2017 Poulakis ..... A44B 18/0073
9,788,674 B2 * 10/2017 Pacione ..... A47G 27/0293
10,024,056 B2 * 7/2018 Pacione ..... E04C 2/00
10,132,086 B2 * 11/2018 Wood ..... E04F 13/0882
2001/0002526 A1 * 6/2001 Lombardo ..... B44C 1/28 52/391
2001/0017017 A1 * 8/2001 Pacione ..... A47G 27/025 52/506.05
2001/0042350 A1 * 11/2001 Pacione ..... A47G 27/0293 52/506.1
2003/0029110 A1 * 2/2003 Pacione ..... A47G 27/025 52/311.2
2005/0055976 A1 * 3/2005 Pacione ..... A47G 27/0293 52/745.19
2005/0166372 A1 * 8/2005 Shepard ..... A44B 18/0049 24/442
2005/0181352 A1 * 8/2005 Shephard ..... A01K 5/0114 434/428
2006/0003141 A1 * 1/2006 Pacione ..... A47G 27/025 428/95
2006/0191218 A1 * 8/2006 Pacione ..... A47G 27/0243 52/234
2007/0079572 A1 * 4/2007 Pacione ..... A47G 27/025 52/506.05
2007/0204428 A1 * 9/2007 Pacione ..... A47G 27/025 16/4
2007/0204556 A1 * 9/2007 Pacione ..... A47G 27/0293 52/745.21
2009/0038251 A1 * 2/2009 Pacione ..... A47G 27/0293 52/506.05
2012/0011795 A1 * 1/2012 Pacione ..... A47G 27/0293 52/506.05
2013/0052400 A1 2/2013 Cheng
2013/0097834 A1 * 4/2013 Pacione ..... E04C 2/00 29/402.08
2015/0204063 A1 * 7/2015 Poulakis ..... A44B 18/0073 52/309.4
2017/0306632 A1 * 10/2017 Wood ..... E04F 13/0882
2018/0171630 A1 * 6/2018 Pacione ..... E04C 2/00

FOREIGN PATENT DOCUMENTS

JP 2003090310 A 3/2003
WO WO 2005/037011 A1 4/2005
WO WO 2009/018645 A1 2/2009
WO WO 2016/051211 A1 4/2016

OTHER PUBLICATIONS

Great Britain Patent Application No. 1417562.4, filed Oct. 3, 2014 (46 pages).

* cited by examiner

ATTACHMENT SYSTEM, E.G., FOR PANELS

CROSS-REFERENCE TO RELATED APPLICATIONS

This application is the U.S. national phase entry under 35 U.S.C. § 371 of International Application No. PCT/FR2016/052415, filed on Sep. 23, 2016, which claims priority to French Patent Application No. 1559016, filed on Sep. 24, 2015, the entireties of each of which are herein incorporated by reference.

GENERAL TECHNICAL FIELD

The present disclosure relates to attachment systems, and finds a particular application in the field of building, e.g. for fastening panels.

STATE OF THE ART

Laying coverings such as ceramic tiles on a wall, and in particular on a vertical wall, is an operation that is generally difficult and expensive to perform.

The usual techniques consist in applying adhesive on the wall and/or on the back of the covering in question, and then in placing the covering on the wall.

The adhesives have a short setting time, so the user needs to perform laying quickly in order to avoid the adhesive setting before the covering has been applied to the wall, and the user may also need to prepare adhesive regularly. It is generally necessary to hold the covering in position for the time required for the adhesive to set, which is very penalizing.

In order to remedy to those problems associated with using adhesive, proposals have already been made to replace adhesive with a self-gripping type fastener system, thus enabling repositioning to be performed easily and on many occasions without any constraints associated with setting time.

The pair of materials forming the self-gripping fastening then need to be selected in such a manner that the bond formed can support the weight of the covering and hold it in position at least until positioning has been finalized, for example, when applying ceramic tiles, at least until the user has performed the jointing operation between the various tiles that have been laid.

Unfortunately, given the various products presently available, it is found that, after they have been laid, certain coverings, and in particular coverings that are heavy such as ceramic tiles, tend to move away from an initial position as defined by the user, under the effect of the weight of the covering.

Furthermore, that type of fastening gives rise to a phenomenon of gaping and/or slipping, thereby giving the user an impression of laying poorly done. Specifically, in particular when a user presses against a covering such as a tile, the covering is observed to move a little under the effect of the applied pressure, and then returns to its initial position, thereby contributing to giving the impression of laying that has been poorly done, that is not strong enough, or indeed that is felt to be unsafe.

Document WO 2009/018645 in the name of Tacfast Systems describes decorative elements that are to be used on the floor. Self-gripping fastenings for coverings that are applied on a floor present problems that are completely different from self-gripping fastenings for coverings that are applied on walls that may be vertical or sloping, or indeed on a ceiling. The risk of the covering detaching on its own (or detaching under the effect of gravity or indeed under the effect of the weight of the covering) after self-gripping fastening is non-existent when the covering is applied on a floor or on a horizontal wall with the covering situated on top of its support. Specifically, in such a configuration, gravity does not tend to undo the self-gripping bond formed between the support and the covering, regardless of the weight of the covering. In that document WO 2009/018645, an overlap "B" is described between two adjacent decorative elements, and the element overlapping the other can be moved so as to be positioned in a final position. Such movement is possible because only a very small fraction of the hooks and the loops are co-operating together. In Document WO 2009/018645, apart from the fact that the application described is for a floor, it is neither described nor suggested in any way that once the decorative elements are in their final positions they may be capable of moving relative to one another, in particular as a result of a decorative element overlapping an adjacent element being forcibly inserted by the user.

SUMMARY OF THE INVENTION

The present invention thus seeks to satisfy the above-mentioned problems, at least in part.

To this end, the invention provides a system for fastening a covering on a surface, the system comprising:

a first assembly comprising a first retaining element; and a second assembly comprising a second retaining element;

the first and second retaining elements being configured to engage each other so as to form a reversible bond;

the system being characterized in that the first assembly and the second assembly are adapted so as to provide a bond presenting: a first movement under the effect of gravity that is less than 2 millimeters (mm) (0.079 inches (in)) along a first axis X1.

The term "movement under the effect of gravity" is used herein to mean that the covering, because of its mass, presents a weight that is oriented vertically downwards, i.e. towards the gravitational center of the earth. The weight of the covering opposes a resultant formed by the reversible bond between the first and second retaining elements, such that the weight tends to separate the first and second retaining elements.

The resultant formed by the reversible bond between the first and second retaining elements is such that it extends perpendicularly or substantially perpendicularly to the plane formed by the covering from its center of gravity.

In a stabilized position, when the orientation of the weight is parallel and in the same direction as the orientation of the resulting force from the reversible bond between the first and second assemblies, then the slip and the gape under the effect of gravity are zero. The term "stabilized position" is used to mean a position in which the movement of the covering is less than 5 mm (0.20 in) per hour.

In other words, the "movement under the effect of gravity" is understood in the absence of any external force being applied other than the weight of the assembly formed by the covering and its retaining element.

The "movement under the effect of gravity" is measured after the first and second assemblies fitted to the covering and to the surface have been pressed against each other and positioned in a final position. In this final position, the first and second assemblies (and in particular their edges) extend substantially in line with each other, their faces then being substantially parallel. The term "substantially parallel" should be understood as meaning that any inclination between the plane formed by the first assembly and the plane formed by the second assembly is less than 10°, in particular less than 7°, more particularly less than 5° (in particular the edges of the first and second assemblies).

In particular, the first movement under the effect of gravity is not zero along the first axis X1.

By way of example, the first assembly and the second assembly are adapted so as to provide a bond presenting a second movement that is less than 2 mm (0.079 in) along a second axis X2 perpendicular to the first axis X1. One of the axes X1, X2 is then typically in a plane parallel to the plane of the surface, and the other one of the axes X1 and X2 lies in a plane perpendicular to the plane of the surface. The first assembly and the second assembly are then typically adapted so as to provide a bond presenting slip of less than 2 mm (0.079 in), and gape of less than 2 mm (0.079 in), or more precisely slip of less than 1.5 mm (0.059 in), and gape of less than 1.5 mm (0.059 in).

In particular, the first movement under the effect of gravity is not zero along the first axis X2.

In particular, the slip under the effect of gravity is not zero.

In particular, the gape under the effect of gravity is not zero.

For example, the first assembly and the second assembly are adapted so as to provide a bond presenting traction strength (longitudinal traction or indeed so-called "shear" traction) lying in the range 1.0 newtons per square centimeter ($N/cm^2$) (1.45 pound per square inch (psi)) to 20.0 $N/cm^2$ (29.0 psi), in particular in the range 3 $N/cm^2$ (4.35 psi) to 20 $N/cm^2$ (29.0 psi), more particularly in the range 4 $N/cm^2$ (5.8 psi) to 20 $N/cm^2$ (29.0 psi), as measured in compliance with the standard NF EN 13780.

The first assembly and the second assembly may also be adapted to provide a bond presenting peel strength lying in the range 0.05 newtons per centimeter (N/cm) (0.0708 ounce-force inch (ozf.in)) to 5 N/cm (7.081 ozf.in), more particularly in the range 1 N/cm (1.42 ozf.in) to 4 N/cm (5.66 ozf.in), or preferably in the range 0.05 N/cm (0.0708 ozf.in) to 3 N/cm (4.25 ozf.in), as measured in compliance with the standard NF EN 12242.

The first assembly and the second assembly may equally well be adapted so as to provide a bond that presents resistance to perpendicular separation, i.e. separation that is perpendicular or substantially perpendicular to the plane formed by the first assembly or by the second assembly, that lies in the range 0.1 $N/cm^2$ (0.15 psi) to 15 $N/cm^2$ (21.8 psi), more particularly in the range 1 $N/cm^2$ (1.45 psi) to 7 $N/cm^2$ (10.15 psi), still more particularly in the range 1.5 $N/cm^2$ (2.18 psi) to 5.5 $N/cm^2$ (7.97 psi), as measured in compliance with the standard NF G91-103.

The bonding performance of the first and second assemblies, e.g. their peel strength and/or traction strength, are mainly provided by the characteristics of the first and second retaining elements.

Typically, the first retaining element comprises an array of retaining elements comprising hooks having a height Hc lying in the range 0.05 mm (0.0020 in) to 1 mm (0.039 in), and the second retaining element comprises an array of retaining elements comprising loops having a maximum height Hb lying in the range 0.1 mm (0.0039 in) to 3.0 mm (0.12 in), in particular in the range 0.1 mm (0.0039 in) to 2.0 mm (0.079 in), more particularly in the range 0.4 mm (0.016 in) to 1.5 mm (0.059 in), still more particularly in the range 0.5 mm (0.020 in) to 1 mm (0.039 in), or indeed of the order of 0.85 mm (0.033 in)±0.25 mm (0.0098 in). In this example, the value of the maximum height Hb is a mean value obtained by measuring the greatest distance between the root of the loop and the end of the loop remote from the loop, which measurement is performed on at least thirty distinct loops of a single retaining element. In other words, all of the loops do not present exactly the same height, some of the loops having a height that is greater than the (average) maximum height Hb and other loops having a height that is smaller than the (average) maximum value Hb. In certain circumstances, a single loop may co-operate with more than one hook at a time. Among the set of loops, it is observed that typically at least 1% of the loops co-operate simultaneously with at least two hooks. Among the set of loops, it is typically observed that at least 80% of the loops co-operate simultaneously with at least two hooks.

By way of example, each hook then comprises a shank and a gripper portion, the gripper portion presenting a maximum height Ht lying in the range 0.01 mm (0.00039 in) to 0.15 mm (0.0059 in), and the shank presenting a diameter lying in the range 0.05 mm (0.0020 in) to 0.80 mm (0.031 in).

The heights Hb and Ht are such that $Hb/Ht>1$, or more particularly such that $2<Hb/Ht<40$, or still more particularly such that $3<Hb/Ht<30$, or indeed such that $3<Hb/Ht<19$.

The second retaining element may present a loop density lying in the range 13 loops per centimeter (33.02 loops per inch) to 30 loops per centimeter (76.2 loops per inch).

The first retaining element may then present a hook density lying in the range 100 hooks per square centimeter ($cm^2$) (645.2 hooks per square inch ($in^2$)) to 500 hooks per $cm^2$ (3,225.8 hooks per $in^2$).

By way of example, the hooks of the first retaining element may be made of polypropylene (PP), and by way of example the loops of the second retaining element may be made of polyamide (PA) and/or of polyethylene terephthalate (PET).

By way of example, the second retaining element presents a number of loops lying in the range 10 loops per $cm^2$ (64.51 loops per $in^2$) to 100 loops per $cm^2$ (645.16 loops per $in^2$), more particularly in the range 10 loops per $cm^2$ (64.51 loops per $in^2$) to 90 loops per $cm^2$ (580.6 loops per $in^2$), or more precisely in the range 30 loops per $cm^2$ (193.5 loops per $in^2$) to 70 loops per $cm^2$ (451.6 loops per $in^2$).

By way of example, the ratio of the number of loops per $cm^2$ over the number of hooks per $cm^2$ is less than 1, or more particularly lies in the range 6% to 70%, or indeed more particularly in the range 6% to 50%.

By way of example, the covering presents a weight per unit area lying in the range 0.04 kilograms per square meter ($kg/m^2$) (0.0082 pound per square foot (psf)) to 30 $kg/m^2$ (6.14 psf), or indeed in the range 1 $kg/m^2$ (0.020 psf) to 30 $kg/m^2$ (6.14 psf), or more particularly in the range 2 $kg/m^2$ (0.41 psf) to 24 $kg/m^2$ (4.92 psf), or indeed more particularly in the range 8 $kg/m^2$ (1.64 psf) to 15 $kg/m^2$ (3.07 psf).

The invention also provides a method of fastening a covering on a surface by means of a fastener system as defined above, wherein the following steps are performed:

- fastening the first assembly on the surface;
- fastening the second assembly on a face of the covering; and
- placing the covering on the surface in such a manner that the retaining elements of the first and second assemblies engage mutually.

The covering fastened using such a method typically presents weight per unit area lying in the range 1 $kg/m^2$ (0.020 psf) to 30 $kg/m^2$ (6.14 psf), or more particularly in the range 2 kg/m$^2$ (0.41 psf) to 24 kg/m$^2$ (4.92 psf), or even more particularly in the range 8 kg/m$^2$ (1.64 psf) to 15 kg/m$^2$ (3.07 psf).

Typically, the second assembly is fastened on a face of the covering in such a manner that said face of the covering is covered in retaining elements up to 100%, more particularly up to 75%, more particularly up to 50%, typically for the most part in the center and at the periphery of the outline of said face of the covering.

The covering typically presents weight per unit area lying in the range 1 kg/m$^2$ (0.020 psf) to 30 kg/m$^2$ (6.14 psf).

SUMMARY OF THE FIGURES

Other characteristics, objects, and advantages of the invention appear from the following description, which is purely illustrative and non-limiting, and which should be read with reference to the accompanying drawing, in which.

In all of the figures, elements that are in common are identified by numerical references that are identical.

DETAILED DESCRIPTION

Figure 1:
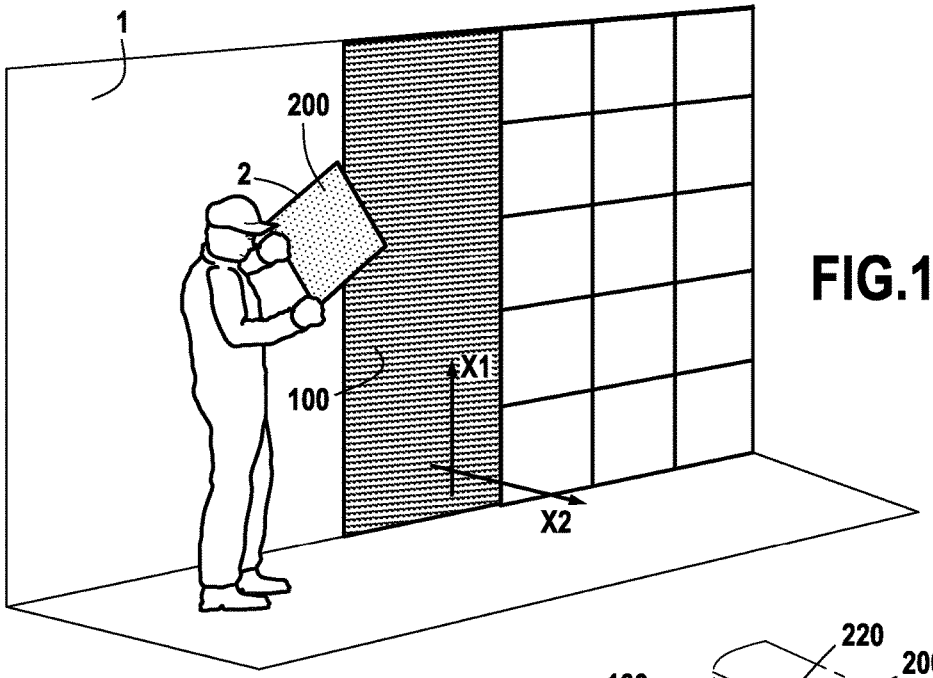
FIG. 1 is a diagram showing an application of a system in an aspect of the invention.

FIG. 1 shows an example application for a system in an aspect of the invention for laying a covering 2 on a surface 1, specifically a wall 1.

In the example shown, the covering 1 is a tile, e.g. a ceramic tile, and the surface 2 is a vertical wall. Nevertheless, it can be understood that this example is not limiting, and that the system in an aspect of the invention can equally well be used for laying a covering on a horizontal wall such as a ceiling or a wall that is sloping relative to the horizontal.

This figure shows a user who is positioning tiles on a vertical wall by means of a fastener system in an aspect of the invention.

In this example, the user has already put three columns of tiles 2 into position on the surface 1, and is about to begin putting a fourth column into position.

For this purpose, the user has fastened a first assembly 100 comprising a first retaining element 120 on a portion of the surface 1 that is to receive the covering 2, and has fastened a second assembly 200 comprising a second retaining element 220 on a face of the covering 2, specifically a face of the tile 2, which face may be referred to as the "rear" face.

In a variant, the fastening operations could be performed directly in a factory, by hot rolling, adhesive, or using other methods, so as to reduce the total time required for laying the covering on a worksite.

Figure 2:
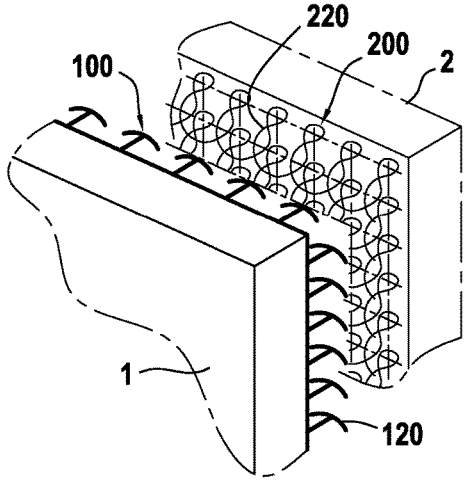
FIGS. 2 to 4 are detail views showing the structure of a system in an aspect of the invention.

FIG. 2 is a close-up view of the surface 1 and of its first assembly 100, together with the covering 2 and its second assembly 200.

The retaining elements 120 and 220 of the first assembly 100 and of the second assembly 200 form a reversible bond, of the self-gripping type, i.e. they engage by being put into contact.

In the example shown, the first retaining element 120 comprises an array of retaining elements comprising hooks, while the second retaining element 220 comprises an array of retaining elements comprising loops.

In the example shown, the surface 1 thus has an array of hooks, while the surface 2 presents loops. The opposite configuration is naturally equally possible; the first and second assemblies may be arranged on the surface 1 and on the covering 2 in such a manner that the covering 2 presents the arrays of hooks while the surface 1 presents the loops. The operation of the system remains unchanged.

Thus, by putting the covering 2 in contact with the surface 1, the first retaining element 120 engages a second retaining example 220 so as to hold the covering 2 in position on the surface 1.

The first and second assemblies 100 and 200 are configured so that the bond that they form presents certain properties, and in particular in such a manner that the bond they form presents first movement under the effect of gravity that is less than 2 mm (0.079 in) along a first axis X1.

As shown in FIG. 1, this first axis X1 may for example be an axis that is parallel to the plane of the surface 1, e.g. a vertical axis, thus representing slip of the covering 2 over the surface 1, or it may be a horizontal axis perpendicular to the surface 1, thus representing gaping of the covering 2 on the surface 1.

The first assembly 100 and the second assembly 200 are typically adapted to provide a bond that presents second movement that is less than 2 mm (0.079 in) along a second axis X2 that is perpendicular to the first axis X1.

The axis X1 may represent the covering 2 slipping over the surface 1, while the axis X2 represents gaping, or vice versa. FIG. 1 shows an example of the axes X1 and X2, with the axis X1 that is vertical and parallel to the surface 1 then representing slip under the effect of the weight of the covering 2, while the axis X2 that is perpendicular to the surface 2 then represents gaping.

The first assembly 100 and the second assembly 200 are thus typically configured so as to form a bond presenting slip of less than 2 mm (0.079 in), and gape of less than 2 mm (0.079 in), or more precisely slip of less than 1.5 mm (0.059 in) and gape of less than 1.5 mm (0.059 in).

Thus, the covering 2 placed on the surface 1 is held in position in a manner that is reliable, and does not give the user an impression of laying that is weak, or poorly performed, or even unsafe.

Furthermore, the first assembly 100 and the second assembly 200 may also be adapted so as to provide a bond presenting traction strength lying in the range 1.0 N/cm$^2$ (1.45 psi) to 20.0 N/cm$^2$ (29.0 psi), and in particular in the range 3 N/cm$^2$ (4.35 psi) to 20 N/cm$^2$ (29.0 psi), or more particularly in the range 4 N/cm$^2$ (5.8 psi) to 20 N/cm$^2$ (29.0 psi), as measured in compliance with the standard NF EN 13780.

The first assembly 100 and the second assembly 200 may also be adapted, in particular for a covering that is flexible, so as to provide a bond that presents peel strength lying in the range 0.05 N/cm (0.0708 ozf.in) to 5 N/cm (7.081 ozf.in), more particularly in the range 1 N/cm (1.42 ozf.in) to 4 N/cm (5.66 ozf.in), or preferably in the range 0.05 N/cm (0.0708 ozf.in) to 3 N/cm (4.25 ozf.in), as measured in compliance with the standard NF EN 12242.

The first assembly 100 and the second assembly 200 may also be adapted so as to provide a bond that presents strength against perpendicular separation, i.e. separation that is perpendicular or substantially perpendicular to the plane formed by the first assembly 100 or the second assembly 200, lying in the range 0.1 N/cm$^2$ (0.15 psi) to 15 N/cm$^2$ (21.8 psi), more particularly in the range 1 N/cm$^2$ (1.45 psi) to 7 N/cm$^2$ (10.15 psi), even more particularly in the range 1.5 N/cm$^2$ (2.18 psi) to 5.5 N/cm$^2$ (7.97 psi) as measured in compliance with the standard NF G91-103.

Figure 3:
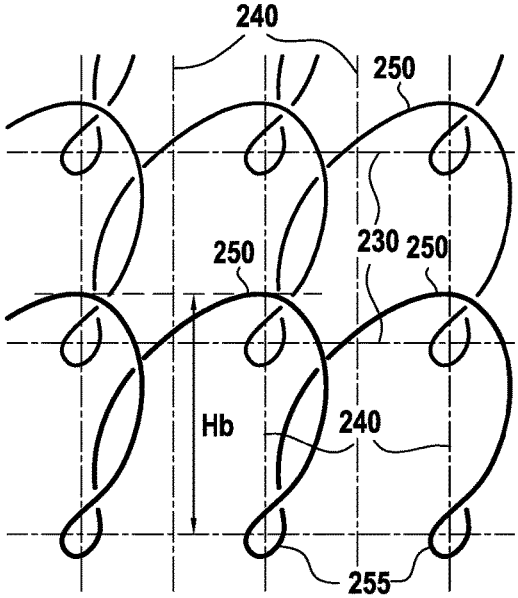
Figure 4:
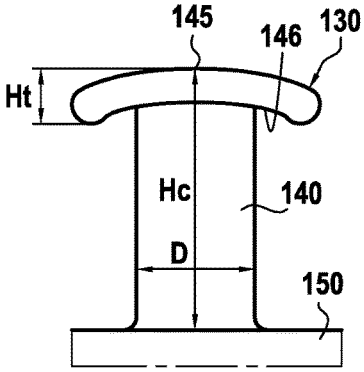

FIG. 3 is a detailed view of the structure of the loops suitable for being used as a retaining element, and FIG. 4 is a detailed view of a hook suitable for being used as a retaining element for co-operating with the loops shown in FIG. 3.

The array of loops shown in FIG. 3 is of the knit type, and in particular of the warp knitting type.

It thus comprises warp yarns 230, and weft yarns 240 that are perpendicular or substantially perpendicular, or in certain circumstances that are inclined, relative to the warp yarns 230; the weft yarns 240 and the warp yarns 230 thus forming a base, e.g. a grid, in which loops 250 are knitted by running or "laddering", each presenting two roots 255, each surrounding an intersection between a warp yarn 230 and a weft yarn 240.

In this example, the loops 250 are formed between two roots 255 arranged in a direction defined by the warp yarns 230.

The direction of the weft yarns 240 thus defines the direction of the loops of the rows of loops 250 arranged in succession, each loop 250 being formed by the yarns connecting together successive roots 255. Since the length of these yarns is longer than the distance between two successive roots 255, these yarns thus form a loop, thereby defining a top of the loop 250 that corresponds to its point furthest away from the warp yarns 230 under consideration, thereby defining for each loop a loop height Hb.

The orientation of the loops relative to gravity defines the type of the array of loops, which may for example be of the "upward loop" type or of the "downward loop" type.

This orientation is defined as a function of the position of the loop 250 relative to the warp yarn 230 surrounded by its roots 255; if the loop 250 is above the warp yarn 230, then the loops are said to be upward loops, and if the loop 250 is below the warp yearn 230, then the loops are said to be downward loops, with "above" and "below" being defined relative to gravity. In FIG. 2, the loops are thus of the "downward" type, whereas in FIG. 3, the loops are of the "upward" type.

As mentioned above, the first assembly 100 and the second assembly 200 are thus typically configured so as to form a bond presenting slip of less than 2 mm (0.079 in), and gape of less than 2 mm (0.079 in), or more precisely slip of less than 1.5 mm (0.059 in) and gape of less than 1.5 mm (0.059 in), these values being obtained regardless of the upward or downward orientation of the loops 250.

When the system is applied to a vertical surface such as a vertical wall, the loops are typically oriented downwards, it being understood that depending on the application, it may be advantageous to use loops that are oriented upwards.

The second retaining element 220 thus typically comprises an array of retaining elements comprising loops having a height Hb lying in the range 0.1 mm (0.0039 in) to 3.00 mm (0.12 in) and in particular in the range 0.1 mm (0.0039 in) to 2.0 mm (0.079 in), more particularly in the range 0.4 mm (0.016) to 1.5 mm (0.059), even more particularly in the range 0.5 mm (0.020 in) to 1 mm (0.039 in), and typically about 0.85 mm (0.033 in)±0.25 mm (0.0098 in).

These values are obtained by measuring the height Hb of a significant number of loops, in this example 92 loops, and then calculating the mean value.

For a loop made up of a plurality of filaments, the value taken into consideration is the mean of the heights of all of the filaments of the loop in question. By way of example, in order to calculate this height Hb, use is made of a rigid and transparent plate that is placed on the loops so as to flatten them, at least in part, against the warp and/or weft yarns, thereby facilitating measuring the height Hb of the loops.

The second retaining element 220 typically presents a loop density lying in the range 7 stitches per centimeter (17.8 stitches per inch) to 30 stitches per centimeter (76.2 stitches per inch), or more particularly lying in the range 13 stitches per centimeter (33.0 stitches per inch) to 30 stitches per centimeter (76.2 stitches per inch).

The loops are typically made of polyamide (PA) or of polyethylene terephthalate (PET), the yarns forming the loops then being by way of example 44 dTex multifilament yarns having ten filaments of polyamide 6 (PA6), and the weft and warp yarns may then, by way of example, be 22 dTex monofilaments of PET. The loops may equally well be made of polypropylene (PP).

In a variant embodiment, the second retaining element could be other than a knitted fabric, for example some other textile with loops, a woven fabric, a non-woven fabric, or a knitted non-woven fabric.

The retaining element with an array of loops is typically adhesively bonded to a support, e.g. a polyolefin film, typically made of low density polyethylene.

FIG. 4 is a diagram showing an example of a hook in an array of hooks as included by way of example in the first retaining element 120.

The hook 130 as shown has a shank 140 extending from a base 150 and surmounted by a head 145.

The shank 140 as shown is generally in the form of a circular cylinder with a diameter D. By way of example, the shank 140 has a cross-section that is polygonal, e.g. rectangular or substantially rectangular or square, e.g. having a ratio of greatest length over greatest width that lies between 1 and 2, with the length dimension extending by way of example in the machine direction (MD).

The head 145 as shown is generally concave in shape, having a maximum dimension that is greater than the diameter D of the shank 140 so as to define attachment portions 146 projecting beyond the shank 140. By way of example, the head 145 may present a projection in plan view that is oval, circular, rectangular, hexagonal, octagonal, or indeed of any shape.

For each hook, a height is defined that corresponds to the distance between the base 150 and its point furthest away from the base, with the distance from the base being measured in a direction perpendicular to that base.

By way of example, the first retaining element 120 thus comprises an array of retaining elements comprising hooks having a height lying in the range 0.05 mm (0.0020 in) to 1 mm (0.039 in).

By way of example, the shank 140 presents a diameter lying in the range 0.05 mm (0.0020 in) to 0.80 mm (0.031 in), and the head 145 then presents a height Ht lying in the range 0.01 mm (0.00039 in) to 0.15 mm (0.0059 in), by way of example, the height of the head Ht being the distance measured along a longitudinal axis of the shank 140, between the point on the head 145 that is furthest away from the base 150 and the point on the head 145 that is closest to the base 150.

The loops 250 and the shanks 140 are typically made in such a manner that the heights Hb and Ht are such that $Hb/Ht>1$, or more precisely such that $2<Hb/Ht<40$, or indeed more precisely such that $3<Hb/Ht<30$, or indeed such that $3<Hb/Ht<19$.

Thus, by way of example, the first retaining element 120 comprise an array of retaining elements made up of hooks, with the hooks being at a density lying in the range 100 hooks per $cm^2$ (645.2 hooks per $in^2$) to 500 hooks per $cm^2$ (3,225.8 hooks per $in^2$), more particularly in the range 110 hooks per $cm^2$ (709.7 hooks per $in^2$) to 500 hooks per $cm^2$ (3,225.8 hooks per $in^2$), or more precisely in the range 200 hooks per $cm^2$ (1,290.3 hooks per $in^2$) to 400 hooks per $cm^2$ (2,580.6 hooks per $in^2$), or indeed in the range 250 hooks per $cm^2$ (1,612.9 hooks per $in^2$) to 350 hooks per $cm^2$ (2,258.1 hooks per $in^2$).

The hooks are typically made of polypropylene (PP).

The second retaining element 220 typically presents a number of loops lying in the range 10 loops per $cm^2$ (64.5 loops per $in^2$) to 100 loops $cm^2$ (645.2 loops per $in^2$), or more particularly in the range 10 loops per $cm^2$ (64.5 loops per $in^2$) to 90 loops per $cm^2$ (580.6 loops per $in^2$), still more particularly in the range 30 loops per $cm^2$ (198.5 loops per $in^2$) to 70 loops per $cm^2$ (451.6 loops per $in^2$).

The first retaining element 120 and the second retaining element 220 are typically made in such a manner that the ratio of the number of loops per $cm^2$ (loops per $in^2$) over the number of hooks per $cm^2$ (hooks per $in^2$) is less than 1, more particularly lying in the range 6% to 70%, or still more particularly in the range 6% to 50%.

Such a ratio increases the probability of a loop co-operating with a plurality of hooks.

The first assembly 100 and/or the second assembly 200 is/are advantageously selected in such a manner that the weight of at least one of said assemblies that is fastened to the covering 2 is less than the weight of the covering 2.

The first assembly 100 and/or the second assembly 200 thus typically present weight lying in the range 50 grams per square meter ($g/m^2$) (0.010 pound per square foot (psf)) to 300 $g/m^2$ (0.061 psf), or indeed in the range 100 $g/m^2$ (0.020 psf) to 200 $g/m^2$ (0.041 psf). The covering 2 typically presents weight per unit area lying in the range 0.04 $kg/m^2$ (0.0082 psf) to 30 $kg/m^2$ (6.14 psf), or in the range 1 $kg/m^2$ (0.20 psf) to 30 $kg/m^2$ (6.14 psf), or indeed in the range 2 $kg/m^2$ (0.41 psf) to 24 $kg/m^2$ (4.92 psf), or more particularly in the range 8 $kg/m^2$ (1.64 psf) to 15 $kg/m^2$ (3.07 psf), by way of example, it might comprise a ceramic tile weighing 600 grams (g) (1.32 pounds (lbs)) having dimensions of 20 centimeters (cm) (50.8 in)×25 cm (63.5 in), giving a weight per unit area equal to 12 $kg/m^2$ (2.46 psf).

The composition of the covering 1 typically comprises at least 30%, in particular at least 40%, more particularly at least 50% of one of the following materials: wood pulp; paper pulp; gypsum; ceramic paste; clays; porcelain; terra cotta; grit; polyvinylchloride (PVC); polyester resin; glass; natural stone; wood; mineral material; a siliceous mineral material; or a calcarous mineral material.

The composition of the wall or of the support typically comprises at least 30%, in particular at least 40%, more particularly at least 50% of one of the following materials: wood pulp; paper pulp; gypsum; ceramic paste; clays; porcelain; terra cotta; grit; polyvinylchloride (PVC); polyester resin; glass; natural stone; wood; mineral material; a siliceous mineral material; or a calcarous mineral material.

The loop typically presents thickness lying in the range 0.1 mm (0.0039 in) to 0.6 mm (0.0236 in), or more particularly in the range 0.3 mm (0.0118 in) to 0.35 mm (0.0138), as measured in compliance with the standard NF EN ISO 9073-2 (0.1 kilopascals (kPa) (0.015 pound-force per square inch), 10 seconds (s)).

The described examples of hooks and loops are examples of retaining elements capable of constituting the first assembly 100 and the second assembly 200 in such a manner as to obtain a bond that presents the desired characteristics.

It is also possible to use other types of hooks and loops.

In order to use a system as described above for fastening a covering on a surface, a user typically performs the following steps:

fastening one of the first assembly 100 and the second assembly on the surface 1;

fastening the other of the first assembly 100 and the second assembly 200 on a face of the covering 2; and in a single step, placing the covering 2 on the surface 1, so that the retaining elements 120 and 220 of the first and second assemblies 100 and 200 engage mutually.

During the placing step, the placed covering is at a distance from an adjacent covering that has already been put into place. This separation distance may lie in the range 0.01 mm (0.00039 in) to 30 mm (1.18 in), as a function of the type of covering being put into place. For a covering of the ceramic tile type, the separation distance is about 5 mm (0.20 in). The first assembly 100 and the second assembly 200 are respectively fastened to the surface 1 and to the covering 2, e.g. by means of an adhesive, a glue, or any other appropriate fastener element.

Thus, once these assemblies have been fastened, the user can easily position them and if necessary reposition them, without being hindered by the constraints associated with using adhesive. The user can thus easily remove the covering 1 from the surface 2, e.g. when it is desired to change it.

The assembly 100 or 200 fastened on a face of the covering 2 is typically fastened in such a manner that said face of the covering 2 is covered in the retaining element up to 100%, more particularly up to 75%, more particularly up to 50%, typically in such a manner that the retaining elements are located for the most part at the center and at the periphery outlining by the face of the covering 2.

In order to measure the gape of the covering on the surface of the vertical wall, the following steps are typically performed:

B1: attaching (e.g. with adhesive or a self-gripping fastener) an additional weight of 1 kg (2.2 lbs) on the outside face of the covering (its face opposite from its face on which the retaining elements are arranged), and at the center of the covering;

B2: placing the covering 2 and the additional weight on the surface 1, in such a manner that the retaining elements 120 and 220 of the first and second assemblies 100 and 200 engage mutually;

B3: while holding the covering and the additional weight in the position of B2, measuring the distance (bi) between the covering and the vertical wall along an axis perpendicular or substantially perpendicular to the wall, this distance bi corresponding to the maximum spacing between the vertical wall and the covering in this configuration;

B4: suddenly letting go the covering and the additional weight; and

B5: three hours after step B4, measuring the distance (b1) between the covering and the vertical wall along an axis perpendicular or substantially perpendicular to the wall and in similar manner to step B3. This distance b1 corresponds to the maximum spacing between the vertical wall and the covering in this configuration.

The gape corresponds to the difference between the measurements taken in steps B5 and B3, i.e. b1-bi.

The measurements of steps B3 and B5 are typically performed by laser.

In order to measure the slip of the covering on the surface of the vertical wall, the following steps are typically performed:

G1: attaching (e.g. with adhesive or a self-gripping fastener) an additional weight of 1 kg (2.2 lbs) on the outside face of the covering (its face opposite from its face on which the retaining elements are arranged), and at the center of the covering;

G2: placing the covering 2 with the additional weight on the surface 1 (a vertical wall in this example), in such a manner that the retaining elements 120 and 220 of the first and second assemblies 100 and 200 engage mutually;

G3: while holding the covering and the additional weight in the position of step G2, measuring the height (gi) of the position of the covering with the additional weight relative to an axis that is parallel or substantially parallel to the vertical wall;

G4: suddenly letting go the covering and the additional weight; and

G5: three hours after step G4, measuring the new height (g1) of the position of the covering with the additional weight relative to the vertical wall along an axis that is parallel or substantially parallel to the wall, and in similar manner to step G3.

The slip corresponds to the difference between the measurements taken in steps G5 and G3, i.e. g1-gi.

The measurements in steps G3 and G5 are typically performed by laser.

It should be observed that the described examples of methods present steps in common, so the measurements of slip and of gape can be performed simultaneously on a single sample.

It should also be observed that the use of an additional weight of 1 kg (2.2 lbs) seeks solely to reduce the time needed for taking the measurements by accelerating the movement of the covering so that the length of waiting required between steps B4 and B5 and between steps G4 and G5 is not excessive, but without that amplifying the movement.

The invention claimed is:

1. A system for fastening a covering on a surface, the system comprising:

a first assembly comprising a first retaining element; and a second assembly comprising a second retaining element;

the first and second retaining elements being configured to engage with each other so as to form a reversible bond;

the system being characterized in that the first retaining element comprises an array of retaining elements comprising hooks having a total height which is equal to or more than 0.05 mm (0.0020 in) and equal to or less than 1 mm (0.039 in), and the second retaining element comprises an array of retaining elements comprising loops having a height which is equal to or more than 0.1 mm (0.0039 in) and equal to or less than 3.0 mm (0.12 in), in such a manner that the first assembly and the second assembly are adapted so as to provide a bond that presents a first movement under an effect of gravity that is less than 2 mm (0.079 in) along a first axis, and wherein each hook comprises a shank and a gripper portion, the gripper portion presenting a height (Ht) which is a portion of the total height of the hook and is equal to or more than 0.01 mm (0.00039 in) and equal to or less than 0.15 mm (0.0059 in), and the shank presenting a section which comprises a maximum dimension and a minimum dimension that are both equal to or more than 0.05 mm (0.0020 in) and equal to or less than 0.80 mm (0.031 in).

2. The system according to claim 1, wherein the first assembly and the second assembly are adapted so as to provide a bond presenting traction strength which is equal to or more than 1.0 N/cm$^2$ (1.45 psi) and equal to or less than 20.0 N/cm$^2$ (29.0 psi).

3. The system according to claim 1, wherein the retaining elements of the first assembly, and the retaining elements of the second assembly, are adapted to provide a bond presenting peel strength which is equal to or more than 0.05 N/cm (0.0708 ozf.in) and equal to or less than 5 N/cm (7.081 ozf.in).

4. The system according to claim 1, wherein the first assembly and the second assembly are adapted so as to provide a bond presenting a second movement that is less than 2 mm (0.079 in) along a second axis perpendicular to the first axis.

5. The system according to claim 4, wherein one of the axes lies in a plane parallel to a plane of the surface, and the other one of the axes lies in a plane perpendicular to the plane of the surface.

6. The system according to claim 5, wherein the first assembly and the second assembly are adapted so as to provide a bond presenting slip of less than 2 mm (0.079 in), and gape of less than 2 mm (0.079 in).

7. The system according to claim 1, wherein the loops of the second retaining element having the height (Hb) which is equal to or more than 0.4 mm (0.016 in) and equal to or less than 1.5 mm (0.060 in).

8. The system according to claim 7, wherein the heights of the loops and gripper portion (Hb and Ht) are such that Hb/Ht>1.

9. The system according to claim 7, wherein the second retaining element presents a loop density which is equal to or more than 7 stitches per cm (17.8 stitches per in) and equal to or less than 30 stitches per cm (76.2 stitches per in).

10. The system according to claim 7, wherein the first retaining element presents a hook density which is equal to or more than 100 hooks per cm$^2$ (645.2 hooks per in$^2$) and equal to or less than 500 hooks per cm$^2$ (3,225.8 hooks per in$^2$).

11. The system according to claim 7, wherein the hooks of the first retaining element are made of polypropylene, and wherein the hooks of the second retaining element are made of polyamide or of polyethylene terephthalate.

12. The system according to claim 7, wherein the second retaining element presents a number of loops which is equal to or more than 10 loops per cm$^2$ (64.5 loops per in$^2$) and equal to or less than 100 loops per cm$^2$ (645.2 loops per in$^2$).

13. The system according to claim 7, wherein the ratio of the number of loops per cm$^2$ (loops per in$^2$) over the number of hooks per cm$^2$ (hooks per in$^2$) is less than 1.

14. A system for fastening a covering on a surface, the system comprising:

a first assembly comprising a first retaining element; and a second assembly comprising a second retaining element;

the first and second retaining elements being configured to engage with each other so as to form a reversible bond;

wherein the first retaining element comprises an array of retaining elements comprising hooks having a total height which is equal to or more than 0.05 mm (0.0020 in) and equal to or less than 1 mm (0.039 in), and the second retaining element comprises an array of retaining elements comprising loops having a height which is equal to or more than 0.1 mm (0.0039 in) and equal to or less than 3.0 mm (0.12 in), in such a manner that the first assembly and the second assembly are adapted so as to provide a bond that presents a first movement under an effect of gravity that is less than 2 mm (0.079 in) along a first axis, and wherein each hook comprises a shank and a gripper portion, the gripper portion presenting a height which is equal to or more than 0.01 mm (0.00039 in) and equal to or less than 0.15 mm (0.0059 in), and the shank presenting a diameter which is equal to or more than 0.05 mm (0.0020 in) and equal to or less than 0.80 mm (0.031 in).

15. The system according to claim 14, wherein the first assembly and the second assembly are adapted so as to provide a bond presenting a second movement that is less than 2 mm (0.079 in) along a second axis perpendicular to the first axis, wherein one of the axes lies in a plane parallel to the plane of the surface, and the other one of the axes lies in a plane perpendicular to the plane of the surface, and wherein the first assembly and the second assembly are adapted so as to provide a bond presenting slip of less than 2 mm (0.079 in), and gape of less than 2 mm (0.079 in).

16. A system for fastening a covering on a surface, the system comprising:

a first assembly comprising a first retaining element; and a second assembly comprising a second retaining element;

the first and second retaining elements being configured to engage with each other so as to form a reversible bond;

wherein the first retaining element comprises an array of retaining elements comprising hooks having a total height which is equal to or more than 0.05 mm (0.0020 in) and equal to or less than 1 mm (0.039 in), and the second retaining element comprises an array of retaining elements comprising loops having a height which is equal to or more than 0.1 mm (0.0039 in) and equal to or less than 3.0 mm (0.12 in), in such a manner that the first assembly and the second assembly are adapted so as to provide a bond that presents a first movement under an effect of gravity that is less than 2 mm (0.079 in) along a first axis, and wherein each hook comprises a shank and a gripper portion, the gripper portion presenting a height (Ht) which is a portion of the total height of the hook and is equal to or more than 0.01 mm (0.00039 in) and equal to or less than 0.15 mm (0.0059 in), and the shank presenting a cross-section with an area that is equal to or more than $\pi/4\times(0.05)^2$ mm$^2$ ($\pi/4\times0.0020^2$ in$^2$) and equal to or less than $\pi/4\times0.80^2$ mm$^2$ ($\pi/4\times0.031^2$ in$^2$).

17. The system according to claim 16, wherein the first assembly and the second assembly are adapted so as to provide a bond presenting a second movement that is less than 2 mm (0.079 in) along a second axis perpendicular to the first axis, wherein one of the axes lies in a plane parallel to the plane of the surface, and the other one of the axes lies in a plane perpendicular to the plane of the surface, and wherein the first assembly and the second assembly are adapted so as to provide a bond presenting slip of less than 2 mm (0.079 in), and gape of less than 2 mm (0.079 in).

18. An assembly comprising the system according to claim 1 together with a covering, wherein the covering presents weight per unit area which is equal to or more than 1 kg/m$^2$ (0.020 psf) and equal to or less than 30 kg/m$^2$ (6.14 psf).

19. A method of fastening a covering on a surface by means of the fastener system according to claim 1, wherein the following steps are performed:

fastening the first assembly on the surface;

fastening the second assembly on a face of the covering; and placing the covering on the surface in such a manner that the retaining elements of the first and second assemblies engage mutually.

20. The method according to claim 19, wherein the second assembly is fastened on a face of the covering in such a manner that said face of the covering is covered in retaining elements up to 100%.

* * * * *